US009347709B2

(12) United States Patent
Schantl et al.

(10) Patent No.: US 9,347,709 B2
(45) Date of Patent: May 24, 2016

(54) IMPACT TOOL FOR A HAMMER DEVICE AND METHOD FOR OPENING A TAPPING OPENING

(71) Applicant: TMT-BBG RESEARCH AND DEVELOPMENT GMBH, Kapfenberg (AT)

(72) Inventors: Werner Schantl, Mitterdorf (AT); Michael Wolfsberger, Trofaiach (AT)

(73) Assignee: TMT-BBG RESEARCH AND DEVELOPMENT GMBH, Kapfenberg (AT)

( * ) Notice: Subject to any disclaimer, the term of this patent is extended or adjusted under 35 U.S.C. 154(b) by 723 days.

(21) Appl. No.: 13/627,297

(22) Filed: Sep. 26, 2012

(65) Prior Publication Data

US 2013/0075120 A1 Mar. 28, 2013

(30) Foreign Application Priority Data

Sep. 27, 2011 (AT) ..... 1397/2011

(51) Int. Cl.
*B25B 21/02* (2006.01)
*E21B 7/00* (2006.01)
*F27D 3/15* (2006.01)

(52) U.S. Cl.
CPC ..... *F27D 3/1527* (2013.01); *F27D 3/1536* (2013.01)

(58) Field of Classification Search
CPC .. B25D 9/18; B25D 17/06; B25D 2217/0023; B25D 9/04; B25D 9/02; B25D 9/14; B25D 9/26
USPC ..... 173/1–2
See application file for complete search history.

(56) References Cited

U.S. PATENT DOCUMENTS

| | | | | |
|---|---|---|---|---|
| 3,741,316 | A * | 6/1973 | Alajouanine | 173/107 |
| 3,965,799 | A | 6/1976 | Juvonen et al. | |
| 4,084,486 | A | 4/1978 | Juvonen | |
| 4,181,183 | A * | 1/1980 | Okada | 173/204 |
| 4,282,937 | A * | 8/1981 | Hibbard | 173/1 |

(Continued)

FOREIGN PATENT DOCUMENTS

| | | |
|---|---|---|
| DE | 43 18 571 | 12/1993 |
| EP | 0 168 382 | 1/1986 |
| EP | 0 930 476 | 7/1999 |

OTHER PUBLICATIONS

European Search Report conducted in counterpart European Appin. No. 12 18 1332 (Jan. 17, 2013).

*Primary Examiner* — Robert Long
(74) *Attorney, Agent, or Firm* — Greenblum & Bernstein, P.L.C.

(57) ABSTRACT

Impact tool and method for a hammer device that includes impact tool housing and tubular piston structured and arranged for axial displacement in impact tool housing via pressure medium. Tubular piston has essentially radial pressure surfaces structured and arranged on opposite portions of tubular piston to be acted on with pressure medium. Grooves are formed in impact tool housing that are structured and arranged for a reversal of a direction of a pressure medium impingement on pressure surfaces and discharge or recirculation of medium. Grooves include a control recess formed in tubular piston and at least two control grooves for a shift of pressure medium impingement on pressure surfaces that are arranged axially offset in impact tool housing. A controller is structured and arranged to alternatively activate one of the at least two control grooves via connection channels.

7 Claims, 1 Drawing Sheet

(56) References Cited

U.S. PATENT DOCUMENTS

| | | | | | |
|---|---|---|---|---|---|
| 4,635,531 | A | | 1/1987 | Rode | |
| 5,348,430 | A | | 9/1994 | Metz et al. | |
| 5,392,865 | A | * | 2/1995 | Piras | 173/17 |
| 5,408,768 | A | * | 4/1995 | Karani | 37/466 |
| 5,884,713 | A | * | 3/1999 | Shinohara et al. | 173/206 |
| 5,979,291 | A | * | 11/1999 | Juvonen | 91/239 |
| 2010/0051348 | A1 | * | 3/2010 | Andersson | 175/57 |
| 2010/0193212 | A1 | * | 8/2010 | Konecnik | 173/218 |
| 2011/0000695 | A1 | * | 1/2011 | Saf | 173/201 |
| 2011/0108600 | A1 | * | 5/2011 | Pedicini et al. | 227/2 |
| 2011/0155403 | A1 | * | 6/2011 | Rohrer | 173/114 |
| 2011/0290357 | A1 | * | 12/2011 | Bass et al. | 137/625.5 |
| 2012/0138328 | A1 | * | 6/2012 | Teipel et al. | 173/207 |
| 2013/0081843 | A1 | * | 4/2013 | Tully | 173/221 |

* cited by examiner

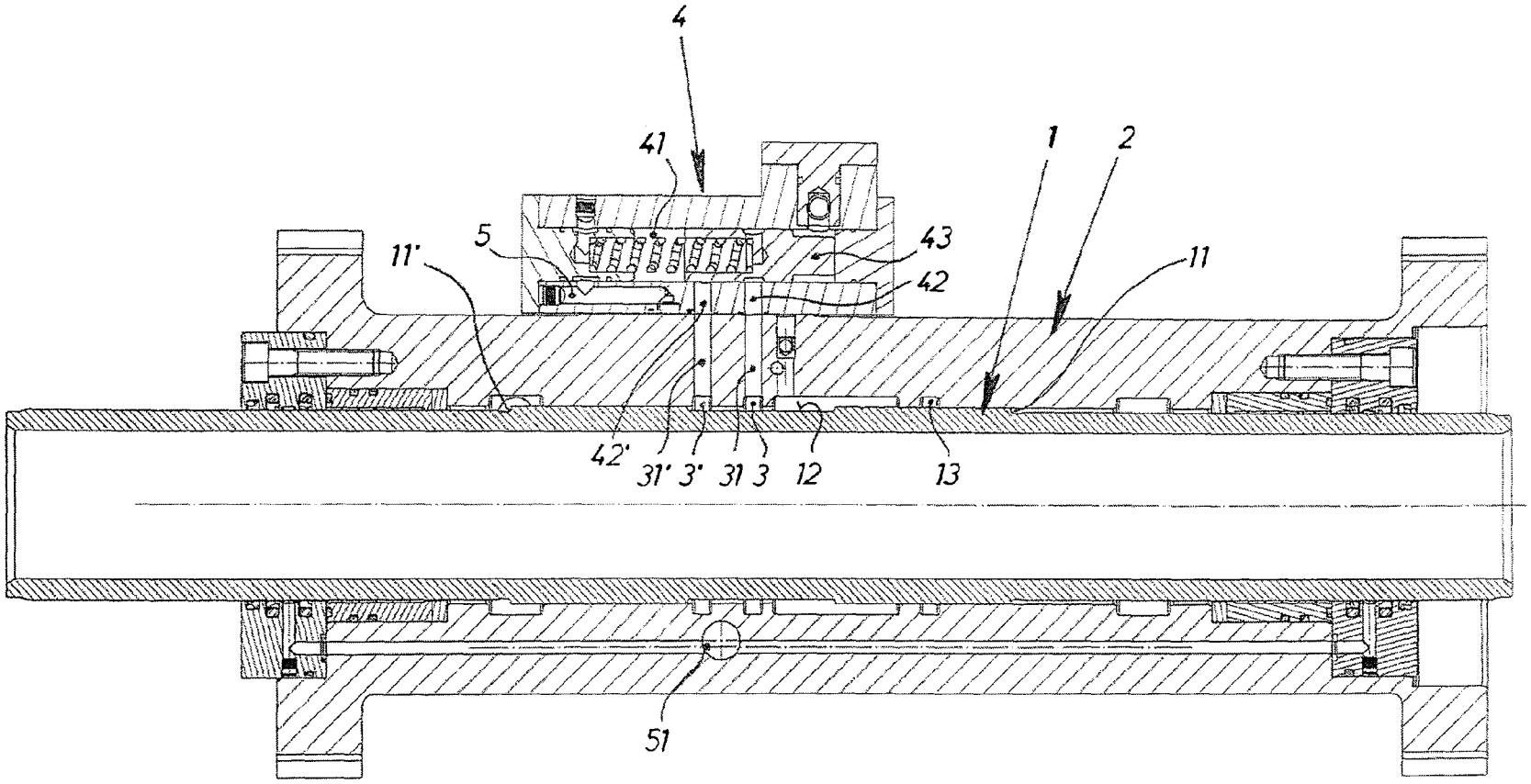
11
2
1
43
42
4
41
5
11'
13
12
3
31
3'
31'
42'
51

IMPACT TOOL FOR A HAMMER DEVICE AND METHOD FOR OPENING A TAPPING OPENING

The present application claims priority under 35 U.S.C. §119 of Austrian Patent Application No. A 1397/2011 filed Sep. 27, 2011, the disclosure of which is expressly incorporated by reference herein in its entirety.

BACKGROUND OF THE INVENTION

1. Field of the Invention

The embodiments of the invention relate to an impact tool for a hammer device that can be used axially in both directions, in particular an impact tool for a hammer drill for opening and optionally for closing a tapping opening of a metallurgical vessel. The impact tool includes a tubular piston that is displaceable in the axial direction by a pressure medium in an impact tool housing. A central or proximal adjustable transfer part of the impact energy connectable to at least one tool and having anvil parts on both sides is also included, as is a device for reversing the direction of the pressure applied to the tubular piston. The tubular piston has essentially radial pressure surfaces on both sides that can be acted on with a pressure medium, and grooves between the tubular piston and the impact tool housing for reversal of a direction of pressure medium impingement on the pressure surfaces and discharge or recirculation of the medium.

Furthermore, embodiments of the invention relate to a method for opening or closing a tapping opening in a wall of a metallurgical vessel provided with a fireproof infeed.

2. Discussion of Background Information

Hammers that can be operated pneumatically or hydraulically with an impact tool, which has tubular pistons that can be acted on respectively axially on both sides with pressure medium are prior art and disclosed, for example, in EP 0 930 476 B1, the disclosure of which is expressly incorporated by reference herein in its entirety. Impact tools of this type are preferably used for devices that cause an advancement or withdrawal of a tool in both directions, such as device for opening and closing tapping openings of metallurgical vessels and the like.

A regulation within limits of the impact energy as well as the impact frequency of the tubular piston can be carried out in a complex manner by conversions of the hammer device or by an adjustment of the quantity per time unit and/or of the pressure of the fed pressure medium.

In the case of metallurgical vessels, such as blast furnaces and the like, it can be favorable to provide a high impact frequency and a low impact force of the tool for opening the taphole in the wall.

When drawing the drilling tool out of the taphole after the penetration in order to prevent a jamming of the same, it is respectively advantageous in terms of process engineering to apply a highest possible backlash force also with lower impact frequency.

SUMMARY OF THE EMBODIMENTS

Embodiments of the invention overcome the disadvantages of impact tools of the type mentioned at the outset for hammer drills and, in a simple manner, create a control for the impact frequency and the impact force of the tubular piston. Furthermore, optionally a shift of the impact frequency and the impact force of the tubular piston with axial change of direction of the tool load should be possible in practical use in order to meet special requirements for hammer devices, in particular in metallurgical plant operations.

Furthermore, embodiments of the invention are directed to a method for opening or closing tapping openings according to the type mentioned at the outset, which has an improved technology with increased operational safety.

In accordance with the embodiments, an impact tool includes a control recess arranged in the tubular piston and at least two control grooves for a shift of the pressure medium impingement on the pressure surfaces that are arranged axially offset in the impact tool housing. Direction reversal grooves are alternately activatable by a controller via connection channels.

The advantages achieved with the embodiments are essentially to be seen in that the tubular piston, depending on which of the direction change grooves, which are offset in the axial direction, is activated, a different displacement or acceleration path is covered, so that, in this manner, changes in the impact frequency and the impact force or impact energy are achieved. Thus, the longer the path for the return stroke of the tubular piston until the change of direction of the pressure medium impingement is provided, the lower the impact frequency and the higher the impact energy of the hammer and vice versa.

Depending on the desired impact criteria of the hammer device, with a simple controller the effectiveness of one of the direction change grooves can be adjusted and thus the work parameters can be established.

A particularly simple and effective control of the tubular piston movement is achieved when the controller of the impact tool connected to the impact tool housing has a cylindrical recess with connection channels to the direction change grooves in the impact tool housing and respectively one of the change of direction grooves can be activated by means of axial positioning of an actuating piston in the recess.

This embodiment of the controller has the advantage that by a simple displacement of the actuating piston in the recess respectively directly effective short flow channel connections are created, which guarantee an exact direction reversal of the tubular piston movement.

According to an embodiment variant, the actuating piston can be positioned manually or against a spring force by a pressure medium in the recess of the controller.

In this manner, an alternative automatic adjustment of the tubular piston movement can be caused when the hammer device is moved hydraulically or pneumatically.

If, in a further embodiment of the invention, an adjustment and a withdrawal of the hammer device take place in situ respectively by a pressure medium and in this manner the position of the actuating piston in the controller can be adjusted depending on the impact direction of the hammer device, for example, in metallurgical plant operations, an opening or a closing of the tapping opening of metallurgical vessels can be carried out automatically according to a favorable operating method.

Further embodiments of the invention are directed to an advantageous method using above described impact tool in a hammer device for opening or optionally for closing a tapping opening in a wall provided with a fire-proof infeed of a metallurgical vessel. This method is achieved if an advancement and a retraction of a tool are carried out with different impact energy and/or with different impact frequency.

Fire-proof linings and the like repairs as well as sealing compounds are extremely brittle and crack-sensitive. Thus, if the tool is advanced with high impact energy with an opening of the tapping opening of a metallurgical vessel, larger funnel-shaped chips can be produced in the masonry which require a complex repair. A shift of the impact energy and/or the impact frequency of the tool makes it possible in each case to select the most favorable impact technology.

In an advantageous manner, if a shift of the impact energy and/or the impact frequency of the tool is controlled by a change from advancement to retraction of the hammer device, an improved process technology of the tap of metallurgical vessels can be achieved with high cost-effectiveness.

It has proven to be particularly advantageous if the advancement of the tool is carried out with low impact energy and high impact frequency and the retraction of the same is carried out with high impact energy and low impact frequency.

Embodiments of the invention are directed to an impact tool for a hammer device that includes an impact tool housing and a tubular piston structured and arranged for axial displacement in the impact tool housing via a pressure medium. The tubular piston has essentially radial pressure surfaces structured and arranged on opposite portions of the tubular piston to be acted on with the pressure medium. Grooves are formed in the impact tool housing that are structured and arranged for a reversal of a direction of a pressure medium impingement on the pressure surfaces and discharge or recirculation of the medium. The grooves include a control recess formed in the tubular piston and at least two control grooves for a shift of the pressure medium impingement on the pressure surfaces that are arranged axially offset in the impact tool housing. A controller is structured and arranged to alternatively activate one of the at least two control grooves via connection channels.

According to embodiments, the impact tool can be structured and arranged to be axially usable in both directions.

In accordance with other embodiments of the invention, the impact tool can be an impact tool for a hammer drill for opening and optionally for closing a tapping opening of a metallurgical vessel.

Further, a central or proximal adjustable transfer part for impact energy may be connectable to at least one tool and has anvil parts on both sides.

According to other embodiments, the controller may include a cylindrical recess coupled to the connection channels and an actuating piston in the cylindrical recess structured and arranged to respectively activate one of the at least two control grooves.

In accordance with still other embodiments, the actuating piston can be positionable one of manually or against a spring force via a pressure medium in the cylindrical recess. Moreover, the impact tool can include a hammer device, such that the actuating piston in the control may be positionally adjustable depending on an impact direction of the hammer. Further, an adjustment and a withdrawal of the hammer device can take place in situ.

Embodiments of the invention are directed to a method for at least opening or optionally for closing a tapping opening in a wall of a metallurgical vessel provided with a fire-proof in-feed using the above-described impact tool. The method includes advancing or retracting of the tool with at least one of different impact energy and different impact frequency.

According to embodiments, the impact tool can be part of a hammer device. Further, a shift of at least one of the impact energy and the impact frequency of the tool can be controlled by a change from advancement to retraction of the hammer device.

In accordance with other embodiments of the invention, the advancing of the impact tool can be carried out with low impact energy and high impact frequency.

According to still other embodiments of the invention, the retracting of the impact tool may be carried out with high impact energy and low impact frequency.

In accordance with still yet other embodiments of the present invention, the method can further include closing a tapping opening in a wall of a metallurgical vessel provided with a fire-proof in-feed.

In this manner, with a taphole creation the drilling operation is optimized and in the advancement direction a funnel-shaped chip out of the masonry is largely avoided and during retraction of the tool a removal of the same takes place free from jamming at high speed.

Other exemplary embodiments and advantages of the present invention may be ascertained by reviewing the present disclosure and the accompanying drawing.

BRIEF DESCRIPTION OF THE DRAWINGS

The embodiments of the present invention are further described in the detailed description which follows, in reference to the noted drawing by way of a non-limiting example of an exemplary embodiment of the present invention, and wherein:

FIG. 1 illustrates an impact tool with a controller for a tubular piston

DETAILED DESCRIPTION OF EMBODIMENTS OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIG. 1 shows an impact tool according to embodiments of the invention. However, a transfer part of the impact energy with anvil parts arranged on both sides and the tool(s) are not shown.

A tubular piston 1 is arranged in an impact tool housing 2 in an axially displaceable manner. Tubular piston 1 includes distal pressure surfaces 11 and 11' arranged on opposite sides or ends that are structured to move the piston 1 with any impingement of a pressure medium on the pressure surfaces 11 and 11'.

A direction reversal for the pressure applied on respective pressure surfaces 11 and 11' of the tubular piston 1 is carried out with a device in which the supply and discharge of the pressure medium are changed against a spring force via pressure or relaxation of a control device.

For operation, a feed line 13 for a pressure medium for the impact tool is arranged in a recess formed in the impact tool housing 2.

With an impingement of the pressure medium on pressure surface 11', the tubular piston 1 is axially displaced in the housing 2, i.e., to the right in the illustrated embodiment, until a connection of the feed line 13 of pressure medium 13 and a control recess 12 in the tubular piston 1 is achieved.

A direction reversal of the pressure applied on the pressure surface 11 thus occurs, which forces the tubular piston 1 in the opposite direction, i.e., to the left in the illustrated embodiment.

A recess 12 on the tubular piston 1 projects or extends beyond two control grooves 3, 3' with connection channels 31, 31' coupled to a controller 4. Further, controller 4 includes connection channels 42, 42', which are continued in a recess 41 with an actuating piston 43.

The actuating piston 43 has a recess on an outer surface that is connected to an inner cavity in order to form a discharge channel 51 for a pressure medium. The discharge channel 51 cooperates with a discharge line 5 for a relaxed pressure medium.

The actuating piston 43 can be displaced against a spring so that the recess on the outer surface activates either (a) the channel 31 in the impact tool housing 2 and the channel 42 in the controller 4 or (b) the axially spaced channel 31' in the impact tool housing 2 and channel 42' in the controller 4. This results in alternatively a shorter or longer path of the tubular piston 1 until the direction reversal of the impingement of the pressure surfaces 11 and 11'.

A positioning of the actuating piston 43 in the controller 4 can be carried out in an advantageous manner respectively by the pressure medium for an adjustment or for a retraction of the hammer drill so that an impact energy and/or impact frequency automatically controlled with the axial movement direction thereof can be achieved.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

1 Tubular piston
11, 11' Pressure surfaces on the tubular piston
12 Control recess on the tubular piston
13 Feed line of the pressure medium
2 Impact tool housing
3, 3' Control grooves in the impact tool housing
31, 31' Connection channels
4 Controller
41 Recess in the controller
43 Actuating piston
5 Discharge line for relaxed pressure medium
51 Discharge channel in the impact tool housing

What is claimed:

1. A method for at least opening a tapping opening in a wall of a metallurgical vessel provided with a fire-proof in-feed using an impact tool having an impact tool housing; a tubular piston structured and arranged for axial displacement in the impact tool housing via a pressure medium, the tubular piston having essentially radial pressure surfaces structured and arranged on opposite portions of the tubular piston to be acted on with the pressure medium; grooves formed in the impact tool housing that are structured and arranged for a reversal of a direction of a pressure medium impingement on the pressure surfaces and discharge or recirculation of the medium, wherein a control recess with control pressure surfaces is formed in the tubular piston and the grooves include at least two control grooves that are arranged axially offset in the impact tool housing for a shift of the pressure medium impingement on the control pressure surfaces; and a controller structured and arranged to alternatively activate one of the at least two control grooves via connection channels, comprising:

advancing and retracting the tool with at least one of different impact energy and different impact frequency.

2. The method according to claim 1, wherein the impact tool is part of a hammer device.

3. The method according to claim 2, wherein a shift of at least one of the impact energy and the impact frequency of the tool is controlled by a change from advancement to retraction of the hammer device.

4. The method according to claim 1, wherein the advancing of the impact tool is carried out with low impact energy and high impact frequency.

5. The method according to claim 1, wherein the retracting of the impact tool is carried out with high impact energy and low impact frequency.

6. The method according to claim 1, further comprising closing a tapping opening in a wall of a metallurgical vessel provided with a fire-proof in-feed.

7. A method for at least opening a tapping opening in a wall of a metallurgical vessel provided with a fire-proof in-feed using an impact tool that includes an impact tool housing having at least two axially offset control grooves coupled to respective connection channels; a tubular piston structured and arranged for axial displacement in two directions in the impact tool housing via a pressure medium; two grooves formed in the tubular piston that are axially displaced from each other so that each of the two grooves comprise a pressure surface structured and arranged to be acted on with the pressure medium so as to move the tubular piston in a first or second impact direction; a control recess formed in the tubular piston between the radial pressure surfaces that is structured and arranged to communicate with the at least two axially offset control grooves; and a controller structured and arranged to alternatively activate one of the at least two axially offset control grooves via its respective connection channel to define at least one of different displacement distances or acceleration paths for the tubular piston in the first and second impact directions, the method comprising:

advancing the tool with at least one of different impact energy and different impact frequency as with the retracting of the tool.

* * * * *